US010984738B2

(12) United States Patent
Huang

(10) Patent No.: US 10,984,738 B2
(45) Date of Patent: Apr. 20, 2021

(54) DRIVING DEVICE AND DRIVING METHOD OF DISPLAY PANEL

(71) Applicant: HKC CORPORATION LIMITED, Guangdong (CN)

(72) Inventor: Beizhou Huang, Chongqing (CN)

(73) Assignee: HKC CORPORATION LIMITED, Guangdong (CN)

( * ) Notice: Subject to any disclaimer, the term of this patent is extended or adjusted under 35 U.S.C. 154(b) by 0 days.

(21) Appl. No.: 16/651,586

(22) PCT Filed: Jan. 11, 2018

(86) PCT No.: PCT/CN2018/072193
§ 371 (c)(1),
(2) Date: Mar. 27, 2020

(87) PCT Pub. No.: WO2019/061950
PCT Pub. Date: Apr. 4, 2019

(65) Prior Publication Data

US 2020/0258457 A1 Aug. 13, 2020

(30) Foreign Application Priority Data

Sep. 28, 2017 (CN) ..... 201710893822.0

(51) Int. Cl.
*G09G 3/36* (2006.01)

(52) U.S. Cl.
CPC ..... *G09G 3/36* (2013.01); *G09G 2310/021* (2013.01); *G09G 2310/0283* (2013.01); *G09G 2310/0286* (2013.01)

(58) Field of Classification Search
CPC ..... G09G 2310/021; G09G 2310/0218; G09G 2310/0224; G09G 2310/0281; G09G 2310/0283; G09G 2310/0286; G09G 3/36; G09G 3/3677
See application file for complete search history.

(56) References Cited

U.S. PATENT DOCUMENTS 5,568,163 A 10/1996 Okumura
2001/0022572 A1* 9/2001 Murade ..... G09G 3/3688 345/98
2008/0191980 A1* 8/2008 Jeon ..... G09G 3/3677 345/87

(Continued)

FOREIGN PATENT DOCUMENTS

CN 102262851 A 11/2011
CN 103077690 A 5/2013

(Continued)

*Primary Examiner* — Dmitriy Bolotin
(74) *Attorney, Agent, or Firm* — Muncy, Geissier, Olds & Lowe, P.C.

(57) ABSTRACT

This disclosure provides a driving device and a driving method of a display panel, wherein the display panel comprises a pixel array, and the driving device comprises: at least one first gate driving module disposed on one side of the pixel array and connected to odd-numbered rows of pixels of the pixel array for line-by-line driving the odd-numbered rows of pixels of the pixel array, and at least one second gate driving module disposed on another side of the pixel array and connected to even-numbered rows of pixels of the pixel array for performing the line-by-line driving on the even-numbered rows of pixels of the pixel array.

15 Claims, 4 Drawing Sheets

(56) References Cited

U.S. PATENT DOCUMENTS

| | | | | |
|---|---|---|---|---|
| 2012/0120040 | A1* | 5/2012 | Ogawa | G09G 3/3688 345/208 |
| 2016/0019853 | A1* | 1/2016 | Jiang | G09G 3/3677 345/212 |
| 2016/0180817 | A1* | 6/2016 | Cho | G09G 3/20 345/213 |
| 2016/0267868 | A1* | 9/2016 | Choi | G09G 3/3674 |
| 2017/0115802 | A1* | 4/2017 | Sun | G06F 3/04166 |
| 2018/0095274 | A1* | 4/2018 | Lee | G02B 27/0172 |
| 2018/0108314 | A1* | 4/2018 | Cao | G02F 1/136259 |

FOREIGN PATENT DOCUMENTS

| | | | |
|---|---|---|---|
| CN | 103700358 | A | 4/2014 |
| CN | 104157249 | A | 11/2014 |
| CN | 104464601 | A | 3/2015 |
| CN | 107492363 | A | 12/2017 |
| JP | H0990894 | A | 4/1997 |

* cited by examiner

DRIVING DEVICE AND DRIVING METHOD OF DISPLAY PANEL

BACKGROUND

Technical Field

The embodiment of this disclosure relates to a technical field of a display, and more particularly to a driving device and a driving method of a display panel.

Related Art

With the continuous development of the display technology, display devices such as liquid crystal panels and displays are continuously developed in the directions toward the light-weight, big screen, low power consumption and low cost. The large-size display panels have the good visual effect and are widely used and become a development trend of the display panel.

However, the present large-size display panels are usually driven by way of single-side driving, and the gate drive chips are distributed and disposed on the same side of the pixel array of the display panel to perform scan driving on the pixel array, thereby causing the signal delay on another side of the pixel array to result in the condition of the insufficient charge or poor charge, and this seriously affects the display effect of the display panel.

SUMMARY

This disclosure provides a driving device and a driving method of a display panel to solve the problem, in which the present large-size display panels are usually driven by way of single-side driving, and have the gate drive chips distributed and disposed on the same side of the pixel array of the display panel to perform scan driving on the pixel array, thereby causing the signal delay on another side of the pixel array to result in the condition of the insufficient charge or poor charge, and this seriously affects the display effect of the display panel.

This disclosure provides a driving device of a display panel. The display panel comprises a pixel array, and the driving device comprises at least one first gate driving module and at least one second gate driving module. The at least one first gate driving module is disposed on one side of the pixel array and is connected to odd-numbered rows of pixels of the pixel array for line-by-line driving the odd-numbered rows of pixels of the pixel array; the at least one second gate driving module is disposed on another side of the pixel array and is connected to even-numbered rows of pixels of the pixel array for performing the line-by-line driving on the even-numbered rows of pixels of the pixel array.

In one embodiment, the first gate driving module and the second gate driving module comprise an input buffer unit, a shift register unit, a level conversion unit and an output buffer unit. The input buffer unit is provided for inputs of a bit-shift control signal, a first control signal and a second control signal. Upon inputting the first control signal, when the driving device starts to line-by-line drive the pixel array, a first level signal is outputted at a rising edge of the bit-shift control signal, and a second level signal is outputted at a falling edge of the bit-shift control signal. Upon inputting the second control signal, when the driving device starts to line-by-line drive the pixel array, the second level signal is outputted at the rising edge of the bit-shift control signal, and the first level signal is outputted at the falling edge of the bit-shift control signal. The shift register unit is connected to the input buffer unit for successively, and bit-by-bit, shifts and outputs the received first level signal and second level signal. The level conversion unit is connected to the shift register unit for performing level conversions on the first level signal and the second level signal outputted from the shift register unit to change voltage values of the first level signal and the second level signal; and the output buffer unit connected to the rows of pixels of the pixel array and the level conversion unit for buffering and then outputting the first level signal and the second level signal, obtained after the level conversions, to the rows of pixels of the pixel array to perform the line-by-line driving on the odd-numbered rows of pixels of the pixel array when the input buffer unit is inputted with the first control signal, and when the input buffer unit is inputted with the second control signal the output buffer unit line-by-line drives the even-numbered rows of pixels of the pixel array.

In one embodiment, the shift register unit is a bidirectional shift register, and the input buffer unit is further for inputting a first direction setting signal and a second direction setting signal, and when the first direction setting signal is inputted a signal shifting direction of the bidirectional shift register is set as a first direction and when the second direction setting signal is inputted, the signal shifting direction of the bidirectional shift register is set as a second direction.

In one embodiment, the first direction setting signal and the second direction setting signal are level signals.

In one embodiment, the first control signal and the second control signal are level signals.

In one embodiment, the bit-shift control signal is a pulse signal.

This disclosure further provides a driving device of a display panel. The display panel comprises a pixel array, and the driving device comprises at least two first gate driving modules and at least two second gate driving modules. The at least two first gate driving modules which are disposed on one side of the pixel array, wherein one of the first gate driving module is connected to the first i rows of odd-numbered rows of pixels of the pixel array, where $i \geq 1$ and "i" is a positive integer, and the other first gate driving module is connected to the remaining odd-numbered rows of pixels of the pixel array, and said at least two first gate driving modules line-by-line drive the odd-numbered rows of pixels of the pixel array; and the at least two second gate driving modules which are disposed on another side of the pixel array, wherein one of the second gate driving modules is connected to the first j rows of even-numbered rows of pixels of the pixel array, where $j \geq 1$ and j is a positive integer, and the other second gate driving module is connected to the remaining even-numbered rows of pixels of the pixel array and said at least two second gate driving modules line-by-line drive the even-numbered rows of pixels of the pixel array.

This disclosure further provides a driving method of a display panel, wherein the display panel comprises a pixel array, and the driving method comprises the following steps: disposing at least one first gate driving module on one side of the pixel array, such that the first gate driving module is connected to the odd-numbered rows of pixels of the pixel array, and controlling the first gate driving module to line-by-line drive the odd-numbered rows of pixels of the pixel array, and disposing at least one second gate driving module on another side of the pixel array, such that the second gate driving module is connected to the even-numbered rows of pixels of the pixel array, and controlling the second gate driving module to line-by-line drive the even-numbered rows of pixels of the pixel array.

This disclosure has gate driving modules disposed on two sides of the pixel array to respectively drive the odd-numbered rows of pixels and the even-numbered rows of pixels of the pixel array in a line by line manner to implement the interleaved bilateral gate driving on all rows of pixels of the pixel array, so that the left and right sides of the pixel array are charged uniformly, the visual difference caused by the difference between the charge times of the pixels on the left and right sides of the pixel array can be effectively decreased, and the visual display effect of the pixel array can be thus enhanced.

BRIEF DESCRIPTION OF THE DRAWINGS

To illustrate the technical solutions according to the embodiments of the present invention more clearly, the accompanying drawings for describing the embodiments are introduced briefly in the following. Apparently, the drawings in the following description are only some embodiments of the present disclosure, those of ordinary skill in the art is concerned, without any creative effort, and may also obtain other drawings based on these drawings.

DETAILED DESCRIPTION OF THE INVENTION

In order to make those skilled in the art better understand the technical solution of the present application, in conjunction with the following drawings of the present application example embodiments, the technical solutions in the present application will be clearly and completely described, obviously, the described embodiments are merely part of embodiments of the present application, rather than all embodiments. Based on the embodiments of the present application, all other embodiments of ordinary skill in the art without creative efforts shall be made available, should belong to the scope of the present application.

The terms "including", "comprising" and any variations thereof in the present specification and claims and the drawings described above are intended to cover non-exclusive inclusion. For example, the process comprising a series of steps or unit, method or system or apparatus is not limited to the listed steps or units, but optionally further comprises the step or unit is not listed, or alternatively further comprising for such process, method, article, or device-specific steps or other units. In addition, the terms "first", "second" and "third" etc. are used to distinguish between different objects, and is not for describing a specific order.

Figure 1:
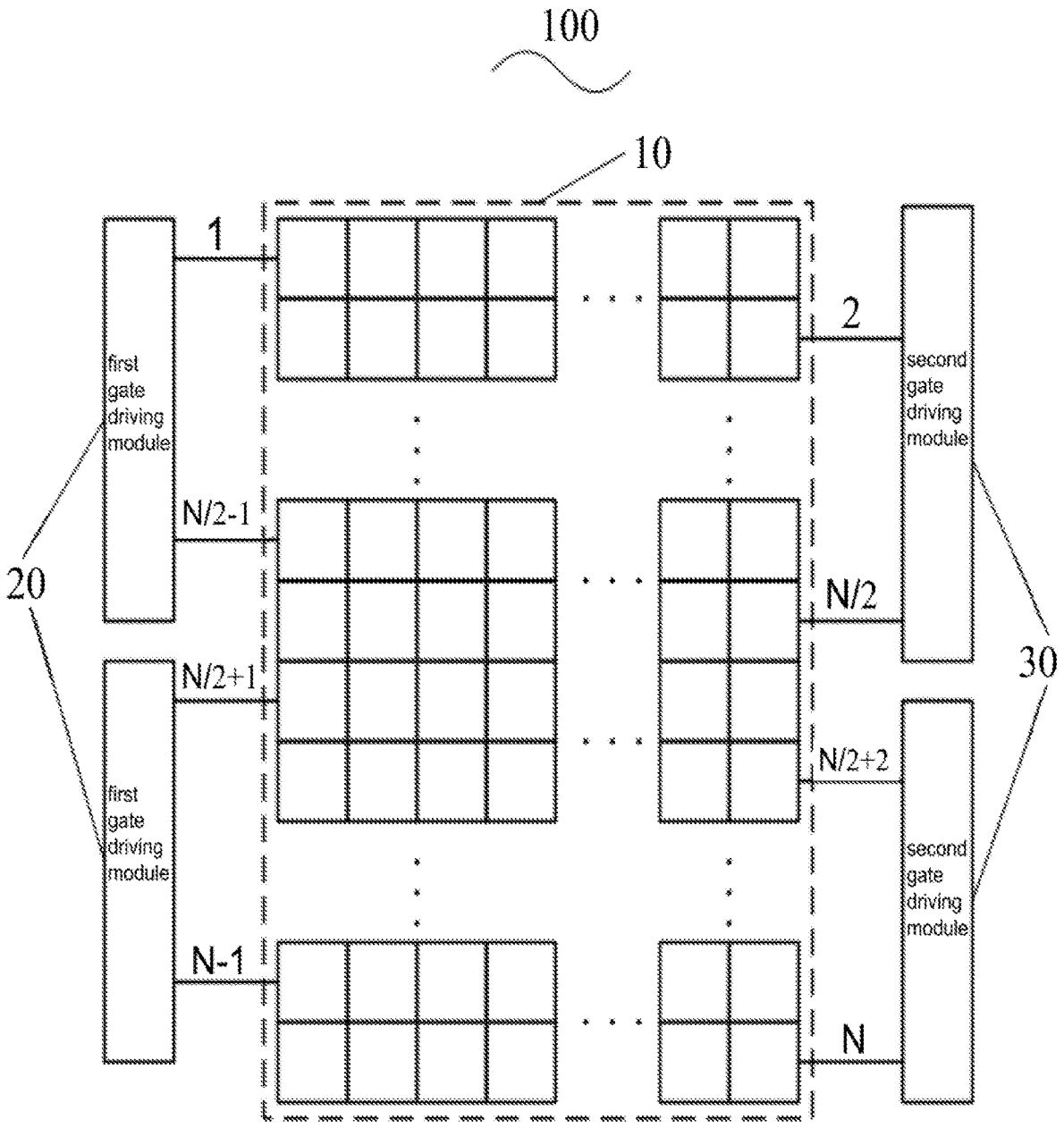
FIG. 1 is a schematic structure view showing a driving device of a display panel provided by one embodiment of this disclosure.

Referring to FIG. 1, one embodiment of this disclosure provides a driving device 100 for driving a display panel 10. The display panel 10 comprises a pixel array constituted by several rows of pixels and several columns of pixels. The driving device for the display panel comprises at least one first gate driving module 20 and at least one second gate driving module 30.

FIG. 1 exemplarily shows a pixel array comprising N rows of pixels, where N is a positive integer greater than 1, and grids are used to exemplarily show the pixels.

The first gate driving module 20, disposed on one side of the pixel array and connected to the odd-numbered rows of pixels of the pixel array, performs the line-by-line driving on the odd-numbered rows of pixels of the pixel array.

The second gate driving module 30, disposed on another side of the pixel array and connected to the even-numbered rows of pixels of the pixel array, performs the line-by-line driving on the even-numbered rows of pixels of the pixel array.

In one embodiment, the driving device comprises two first gate driving modules and two second gate driving modules, wherein one first gate driving module is connected to the first i rows of the odd-numbered rows of pixels of the pixel array, where i, j≥1 and i and j are positive integers, and the other first gate driving module is connected to the remaining odd-numbered rows of pixels of the pixel array. One second gate driving module is connected to the first j rows of the even-numbered rows of pixels of the pixel array, and the other second gate driving module is connected to the remaining even-numbered rows of pixels of the pixel array.

The terms "one side" and "another side" in this embodiment are relative to the arrangement direction of the rows of pixels of the pixel array. In the practical application, any configuration will do as long as the first gate driving module and the second gate driving module can be respectively connected to two ends of the rows of pixels of the pixel array.

In some specific practicing modes, the numbers of the first gate driving module(s) and the second gate driving module(s) may be configured according to the actual requirements, and specifically relate to the number of the row of pixels of the pixel array, the numbers of the gate drive lines of the first gate driving module and the second gate driving module and the driving method. For example, the pixel array comprises 50 rows of pixels (25 odd-numbered rows of pixels and 25 even-numbered rows of pixels), the numbers of the gate drive lines of the first gate driving module and the second gate driving module are equal to 10. If the tri-gate transistor driving method is adopted, the required data of the first gate driving modules and the second gate driving modules are equal to 3, and if the dual-gate driving method is adopted, the numbers of the first gate driving modules and the second gate driving modules are equal to 2. When the number of the gate drive lines of the first gate driving module is equal to 25, and the number of the gate drive lines of the second gate driving module is equal to 10, the required number of the first gate driving module is equal to 1, and the required data of the second gate driving modules is equal to 3 if the tri-gate transistor driving method is adopted, and the required number of the first gate driving module is equal to 1, and the required number of the second gate driving modules is 2 if the dual-gate driving method is adopted.

In one embodiment, the numbers of the first gate driving module(s) and the second gate driving module(s) are equal to each other.

FIG. 1 exemplarily shows the condition where the numbers of the first gate driving modules 20 and the second gate driving modules 30 are equal to 2. When N is an odd number, one of the first gate driving modules 20 is used to drive the first several odd-numbered rows of pixels comprising the first row of pixels, the other first gate driving module 20 is used to drive the later remaining odd-numbered rows of pixels comprising the $N^{th}$ rows of pixels. One second gate driving module 30 is used to drive the first several even-numbered rows of pixels comprising the second row of pixels, and the other second gate driving module 30 is used to drive the later remaining even-numbered rows of pixels comprising the $(N-1)^{th}$ row of pixels. When N is an even number, one of the first gate driving modules 20 is used to drive the odd-numbered rows of pixels in the first to $(N/2-1)^{th}$ rows, and the other first gate driving module 20 is used to drive the odd-numbered rows of pixels in the $(N/2+1)^{th}$ to $(N-1)^{th}$ rows. One second gate driving module 30 is used to drive the even-numbered rows of pixels in the second to $(N/2)^{th}$ rows, and the other second gate driving module 30 is used to drive the even-numbered rows of pixels in the $(N/2+^{2})^{th}$ to $N^{th}$ rows, where $N \geq 1$. FIG. 1 only shows the condition where N is an even number.

In some specific practicing modes, the method of performing the line-by-line driving on the pixel array through the above-mentioned interleaved two side driving modules are specifically configured as follows.

If driving is triggered, the one-by-one driving of all pixel points included in the first row of pixels starts from left to right through the gate driving module disposed on one side of the pixel array, then the one-by-one driving of all pixel points included in the second row of pixels is performed from right to left through the gate drive circuit module disposed on another side of the pixel array, then the one-by-one driving of all pixel points included in the first row of pixels is performed from left to right again through the gate driving module disposed on one side, then the one-by-one driving of all pixel points included in the fourth row of pixels is performed from right to left again through the gate drive circuit module disposed on another side of the pixel array, and so on, until the driving of all pixel points of the whole pixel array is completed.

It is obtained, through the above-mentioned line-by-line driving method, it should be appreciated that the alternating dual-side driving modules provided by this embodiment are able to implement an alternating bilateral gate driving of the pixel array. Accordingly, the left and right sides of the pixel array are charged uniformly, the visual difference caused by the difference between the charge times of the pixels on the left and right sides of the pixel array can be effectively decreased, and the visual display effect of the pixel array can be thus enhanced.

Figure 2:
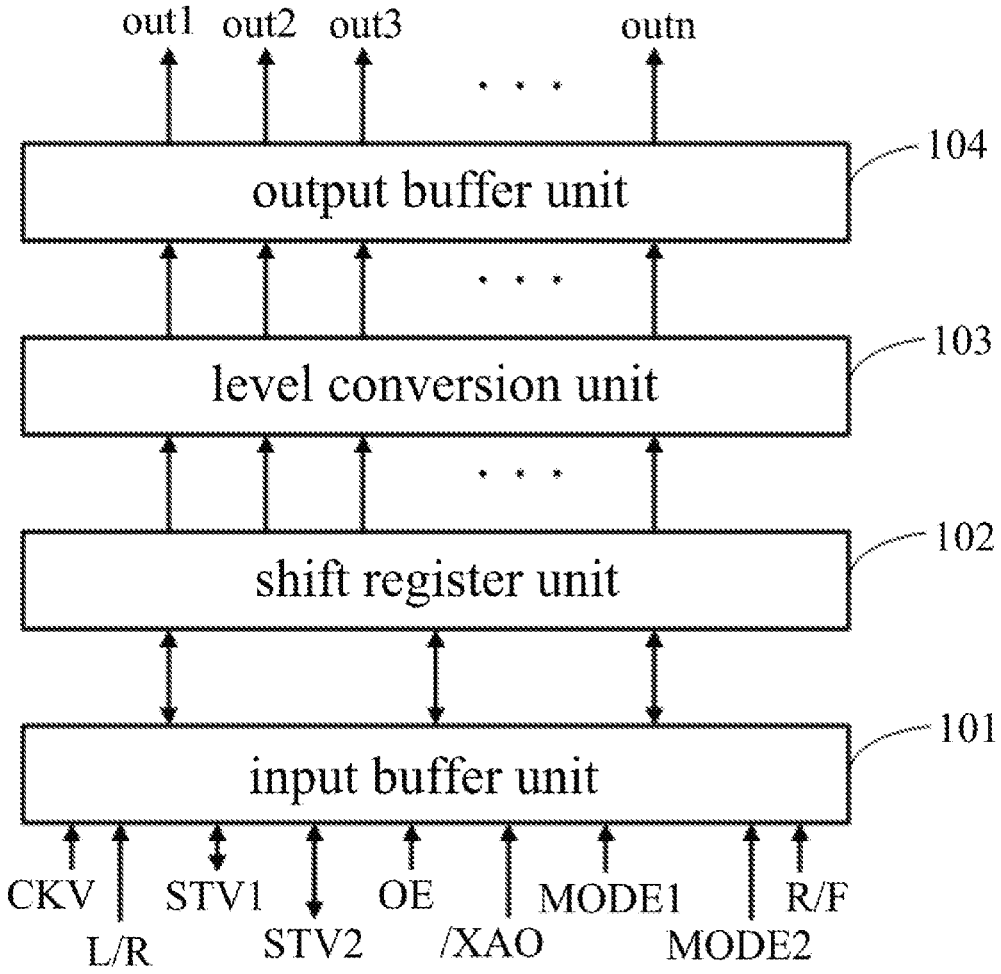
FIG. 2 is a schematic structure view showing a first gate driving module and a second gate driving module provided by one embodiment of this disclosure.

Referring to FIG. 2, in one embodiment of this disclosure, each of the first gate driving module 20 and the second gate driving module 30 comprises an input buffer unit 101, a shift register unit 102, a level conversion unit 103 and an output buffer unit 104.

In some specific practicing modes, the units included in the first gate driving module 20 and the second gate driving module 30 only have the same work principle, but the numbers of the gate drive lines included in the first gate driving module 20 and the second gate driving module 30 may have different configurations according to the actual needs.

The input buffer unit 101 is for inputs of a bit-shift control signal, a first control signal and a second control signal. Upon inputting the first control signal, when the driving device starts to line-by-line drive the pixel array, a first level signal is outputted at the rising edge of the bit-shift control signal, and a second level signal is outputted at the falling edge of the bit-shift control signal, and upon inputting the second control signal, when the driving device starts to line-by-line drive the pixel array, the second level signal is outputted at the rising edge of the bit-shift control signal, and the first level signal is outputted at the falling edge of the bit-shift control signal.

Referring to FIG. 2, this embodiment exemplarily shows that the input buffer unit 101 is provided with a control terminal R/F and a shift control terminal CKV. The shift control terminal CKV is for inputting the bit-shift control signal, and the control terminal R/F is for inputting the first control signal and the second control signal.

In some specific practicing modes, the first level signal is a high level signal, and the second level signal is a low level signal.

In one embodiment, the input buffer unit further comprises a trigger signal terminal STV for inputting a drive start signal, a pull-down signal terminal OE for pulling down the drive signal outputted to all rows of pixels, a pull-up signal terminal/XAO for pulling up the drive signal for all rows of pixels, and a channel select terminal MODE for selecting the number of channels for outputting the drive signal.

Referring to FIG. 2, this embodiment exemplarily shows that the input buffer unit 101 is provided with the pull-down signal terminal OE and the pull-up signal terminal/XAO.

In one embodiment, the bit-shift control signal is a pulse signal.

In one embodiment, the first control signal and the second control signal are level signals, wherein the first control signal is the high level signal, and the second control signal is the low level signal.

In one embodiment, the input buffer unit may be a buffer, or any other buffer memory member having the same buffer storage area function, and this embodiment is not particularly restricted to the specific type.

The shift register unit 102 connected to the input buffer unit 101 successively, and bit-by-bit, shifts and outputs the received first level signal and second level signal.

In one embodiment, the shift register unit is a bidirectional shift register. The input buffer unit is further for the inputting a first direction setting signal and a second direction setting signal, and when the first direction setting signal is inputted a signal shifting direction of the bidirectional shift register is set as a first direction, so that the bidirectional shift register successively, and bit-by-bit, shifts and outputs the first level signal and the second level signal in the first direction, and when the second direction setting signal is inputted, the signal shifting direction of the bidirectional shift register is set as a second direction, so that the bidirectional shift register successively, and bit-by-bit, shifts and outputs the first level signal and the second level signal in the second direction.

The reason of adopting the bidirectional shift register in the above-mentioned embodiment is described in the following. When they are respectively disposed on one side and another side of the pixel array, the drive signal needs to be outputted in two exact opposite directions to drive the pixel array. Therefore, the adopted bidirectional shift register may be the register, which can be disposed on either the one side or another side of the pixel array. It is unnecessary to adopt the shift registers with different driving directions.

In the specific application, the first direction specifically represents the direction from the first signal output terminal to the last signal output terminal of the bidirectional shift register, and the second direction specifically represents the direction from the last signal output terminal to the first signal output terminal of the bidirectional shift register.

Referring to FIG. 2, this embodiment exemplarily shows that the input buffer unit 101 is further provided with a shift direction setting terminal L/R for inputting the first direction setting signal and the second direction setting signal.

In one embodiment, the first control signal and the second control signal are level signals, wherein the first control signal is the high level signal, and the second control signal is the low level signal.

In one embodiment, the input buffer unit comprises: a first trigger signal terminal STV1 for triggering the gate driving module to successively output the drive signal from the first signal output terminal to the last signal output terminal thereof, and a first channel select terminal MODE1 for selecting the number of channels for outputting the drive signal in this case, and a second trigger signal terminal STV2 for triggering the gate driving module to successively output the drive signal from the last signal output terminal to the first signal output terminal thereof, and a second channel select terminal MODE2 selecting the number of channels for outputting the drive signal in this case.

The level conversion unit 103 connected to the shift register unit 102 is for performing level conversions on the first level signal and the second level signal outputted from the shift register unit 102 to change the voltage values of the first level signal and the second level signal.

In some specific practicing modes, the level conversion unit may be a level converter, or a circuit or a device having the same level conversion function.

The output buffer unit 104 connected to the rows of pixels of the pixel array and the level conversion unit 103 for buffering and then outputting the first level signal and the second level signal, obtained after the level conversions, to the rows of pixels of the pixel array to perform the line-by-line driving on the odd-numbered rows of pixels of the pixel array when the input buffer unit is inputted with the first control signal, and when the input buffer unit is inputted with the second control signal the output buffer unit line-by-line drives the even-numbered rows of pixels of the pixel array.

In one embodiment, the output buffer unit may be a buffer, and may also be any other buffer memory member having the same buffer storage area function, and this embodiment is not particularly restricted to the specific type.

Referring to FIG. 2, this embodiment exemplarily shows that the output buffer unit 104 comprises n signal output terminals out1, out2, out3, . . . , out n in total, where n≥1 and n is a positive integer.

Figure 3:
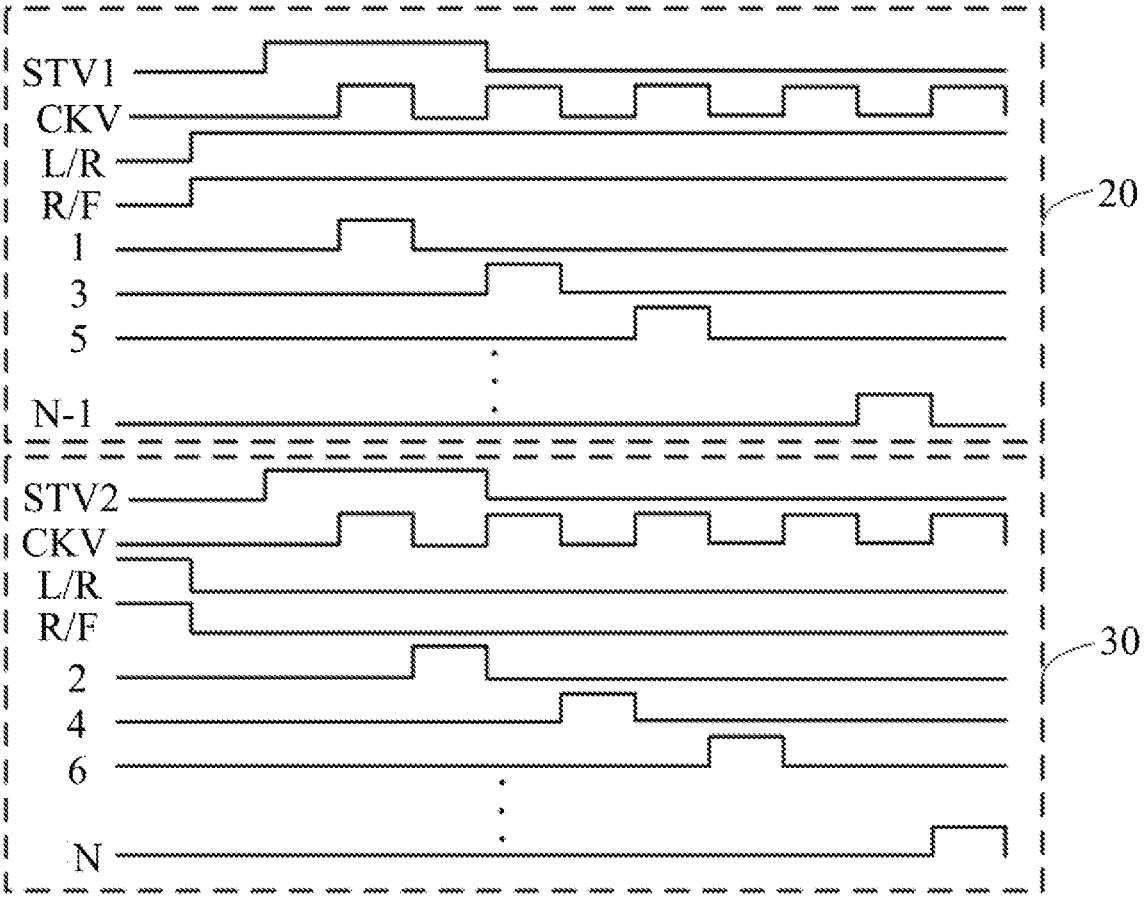
FIG. 3 is a timing chart showing work signals of the first gate driving module and the second gate driving module provided by one embodiment of this disclosure.

FIG. 3 is a timing chart showing work signals of the first gate driving module 20 having the above-mentioned structure and the second gate driving module 30 having the above-mentioned structure provided by one embodiment of this disclosure. FIG. 3 exemplarily shows the work timings when the first gate driving module 20 drives the $1^{st}$, $3^{rd}$, $5^{th}$, . . . , $(N-1)^{th}$ rows of pixels, and when the second gate driving module 30 drives the $2^{nd}$, $4^{th}$, $6^{th}$, . . . , $N^{th}$ rows of pixels, where N≥1 and N is an even number.

In this embodiment, the provision of the control terminal on the input buffer unit of the gate driving module can control the direction of the drive signal outputted from the gate driving module according to the inputted control signal, so that the gate driving module can be disposed on either the one side or another side of the pixel array. Thus, it is unnecessary to provide two different gate driving modules with different driving directions in the driving device, thereby simplifying the assembly process, enhancing the assembly efficiency, and enhancing the compatibility between the devices.

One embodiment of this disclosure further provides a driving device of a display panel, wherein the display panel comprises a pixel array, and the driving device comprises at least two first gate driving modules and at least two second gate driving modules.

The at least two first gate driving modules which are disposed on one side of the pixel array, wherein one of the first gate driving module is connected to the first i rows of the odd-numbered rows of pixels of the pixel array, where i≥1 and "i" is a positive integer, and the other first gate driving module is connected to the remaining odd-numbered rows of pixels of the pixel array, and said at least two first gate driving modules line-by-line drive the odd-numbered rows of pixels of the pixel array.

The at least two second gate driving modules which are disposed on another side of the pixel array, wherein one of the second gate driving modules is connected to the first j rows of the even-numbered rows of pixels of the pixel array, where j≥1 and j is a positive integer and the other second gate driving module is connected to the remaining even-numbered rows of pixels of the pixel array and said at least two second gate driving modules line-by-line drive the even-numbered rows of pixels of the pixel array.

Figure 4:
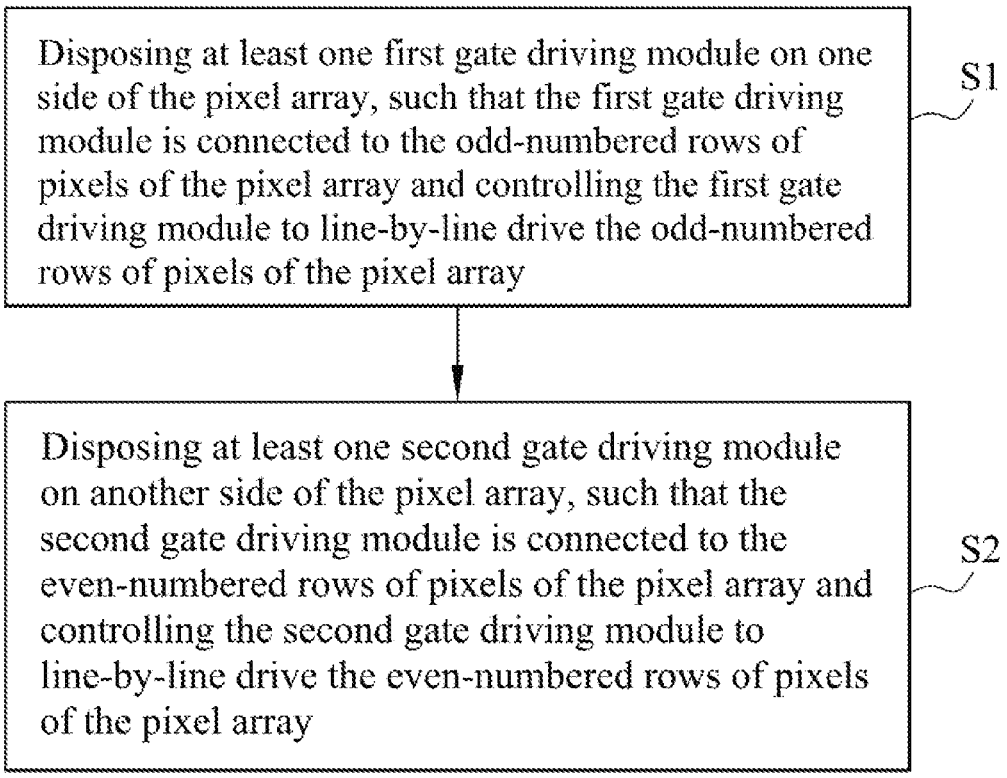
FIG. 4 is a flow chart showing a driving method provided by one embodiment of this disclosure.

Referring to FIG. 4, one embodiment of this disclosure further provides a driving method of a display panel, wherein the display panel comprises a pixel array, and the driving method comprises the following steps.

In a step S1, at least one first gate driving module is disposed on one side of the pixel array, so that the first gate driving module is connected to the odd-numbered rows of pixels of the pixel array, and controls the first gate driving module to perform the line-by-line driving on the odd-numbered rows of pixels of the pixel array.

In a step S2, at least one second gate driving module is disposed on another side of the pixel array, so that the second gate driving module is connected to the even-numbered rows of pixels of the pixel array, and controls the second gate driving module to perform the line-by-line driving on the even-numbered rows of pixels of the pixel array.

In the specific application, the above-mentioned driving method is implemented based on the driving device in this embodiment.

In one embodiment, the control step of the above-mentioned driving method is performed by the control module, which may be specifically a timer/counter control register (TCON, also referred to as a screen driver board), and may further be any other circuit or device with the corresponding function. However, this embodiment is not particularly restricted to the specific type.

The modules or units in all embodiments of this disclosure may be implemented through a general purpose integrated circuit, such as a central processing unit (CPU), or through an application specific integrated circuit (ASIC).

It will be understood by those of ordinary skill in the art that implementing all or part of the processes in the method of the embodiments described hereinabove may be accomplished by a computer program, which is for instructing the associated hardware and may be stored in a computer readable storage medium. The program may include a flow of the embodiment as described above when being executed. The storage medium may be a magnetic disk, a disc, a read-only memory (ROM), a random access memory (RAM) or the like.

The foregoing is only preferred embodiments of the present application only, not intended to limit the present application, any modifications made within the spirit and principle of this application, equivalent replacements and improvements should be included in the present within the scope of the application.

What is claimed is:

1. A driving device of a display panel, wherein the display panel comprises a pixel array, and the driving device comprises:

at least one first gate driving module disposed on one side of the pixel array and connected to odd-numbered rows of pixels of the pixel array for line-by-line driving the odd-numbered rows of pixels of the pixel array, and at least one second gate driving module disposed on another side of the pixel array and connected to even-numbered rows of pixels of the pixel array for line-by-line driving the even-numbered rows of pixels of the pixel array, wherein each the first gate driving module and each the second gate driving module comprise;

an input buffer unit for inputs of a bit-shift control signal, a first control signal and a second control signal: upon inputting the first control signal, when the driving device starts to line-by-line drive the pixel array, a first level signal is outputted at a falling edge of the big-shift control signal, and upon inputting the second control signal, when the driving device starts to line-by-line drive the pixel array, the second level signal is outputted at the rising edge of the bit-shift control signal and the first level signal is outputted at the falling edge of the bit-shift control signal;

a shift register unit connected to the input buffer unit for successively, and bit-by-bit, shifts and outputs the received first level signal and second level signal;

a level conversion unit connected to the shift register unit for performing level conversions on the first level signal and the second level signal outputted from the shift register unit to change voltage values of the first level signal and the second level signal, and an output buffer unit connected to the rows of pixels of the pixel array and the level conversion unit for buffering and then outputting the first level signal and the second level signal, obtained after the level conversions, to the rows of pixels of the pixel array to line-by-line drive the odd-numbered rows of pixels of the pixel array when the input buffer unit is inputted with the first control signal, and when the input buffer unit is inputted with the second control signal the output buffer unit line-by-line drives the even-numbered rows of pixels of the pixel array.

2. The driving device according to claim 1, wherein the shift register unit is a bidirectional shift register, and the input buffer unit is further for inputting a first direction setting signal and a second direction setting signal, and when the first direction setting signal is inputted a signal shifting direction of the bidirectional shift register is set as a first direction, and when the second direction setting signal is inputted, the signal shifting direction of the bidirectional shift register is set as a second direction.

3. The driving device according to claim 2, wherein the first direction setting signal and the second direction setting signal are level signals.

4. The driving device according to claim 1, wherein the first control signal and the second control signal are level signals.

5. The driving device according to claim 1, wherein the bit-shift control signal is a pulse signal.

6. A driving device of a display panel, wherein the display panel comprises a pixel array, and the driving device comprises:

at least two first gate driving modules which are disposed on one side of the pixel array, wherein one of the first gate driving module is connected to first i rows of odd-numbered rows of pixels of the pixel array, where $i \geq 1$ and is a positive integer, and the other first gate driving module is connected to the remaining odd-numbered rows of pixels of the pixel array, and said at least two first gate driving modules line-by-line drive the odd-numbered rows of pixels of the pixel array, and at least two second gate driving modules which are disposed on another side of the pixel array, wherein one of the second gate driving modules is connected to first j rows of even-numbered rows of pixels of the pixel array, where $j \geq 1$ and is a positive integer, and the other second gate driving module is connected to the remaining even-numbered rows of pixels of the pixel array and said at least two second gate driving modules line-by-line drive the even-numbered rows of pixels of the pixel array, wherein each the first gate driving modules and each the second gate driving modules comprise:

an input buffer unit for inputs of a big-shift control signal, a first control signal and a second control signal; upon inputting the first control signal, when the driving device starts to line-by-line drive the pixel array, a first level signal is outputted at a rising edge of the big-shift control signal and a second level signal is outputted at a falling edge of big-shift control signal, and upon inputting the second control signal, when the driving device starts to line-by-line drive the pixel array, the second level signal is outputted at the rising edge of the bit-shift control signal and the first level signal is outputted at the falling edge of the bit-shift control signal, a shift register unit connected to the input buffer unit for successively, and bit-by-bit, shifts and outputs the received first level signal and second level signal, a level conversion unit connected to the shift register unit for performing level conversions on the first level signal and the second level signal outputted from the shift register unit to change voltage values of the first level signal and the second level signal, and an output buffer unit connected to the rows of pixels of the pixel array and the level conversion unit for buffering and then outputting the first level signal and the second level signal, obtained after the level conversions, to the rows of pixels of the pixel array to perform the line-by-line driving on the odd-numbered rows of pixels of the pixel array when the input buffer unit is inputted with the first control signal.

7. The driving device according to claim 6, wherein the shift register unit is a bidirectional shift register, and the input buffer unit is further for inputting a first direction setting signal and a second direction setting signal, and when the first direction setting signal is inputted a signal shifting direction of the bidirectional shift register is set as a first direction, and when the second direction setting signal is inputted, the signal shifting direction of the bidirectional shift register is set as a second direction.

8. The driving device according to claim 7, wherein the first direction setting signal and the second direction setting signal are level signals.

9. The driving device according to claim 6, wherein the first control signal and the second control signal are level signals.

10. The driving device according to claim 6, wherein the bit-shift control signal is a pulse signal.

11. A driving method of a display panel, wherein the display panel includes a pixel array, and the driving method comprises:

disposing at least one first gate driving module on one side of the pixel array, such that the first gate driving module is connected to the odd-numbered rows of pixels of the pixel array and controlling the first gate driving module to line-by-line drive the odd-numbered rows of pixels of the pixel array, and disposing at least one second gate driving module on another side of the pixel array, such that the second gate driving module is connected to the even-numbered rows of pixels of the pixel array and controlling the second gate driving module to line-by-line drive the even-numbered rows of pixels of the pixel array, wherein each the first gate driving module and each the second gate driving module comprise;

an input buffer unit for inputs of a bit-shift control signal, a first control signal and a second control signal, upon inputting the first control signal, when the driving device starts to line-by-line drive the pixel array, a first level signal is outputted at the rising edge of the bit-shift control signal and a second level signal is outputted at the falling edge of the bit-shift control signal, and upon inputting the second control signal, when the driving device starts to line-by-line drive the pixel array, the second level signal is outputted at the rising edge of the big-shift control signal and the first level signal is outputted at the falling edge of the bit-shift control signal;

a shift register unit connected to the input buffer unit for successively, and bit-by-bit shifts and outputs the received first level signal and second level signal;

a level conversion unit connected to the shift register unit for performing level conversions on the first level signal and the second level signal outputted from the shift register unit to change the voltage values of the first level signal and the second level signal, and an output buffer unit connected to the rows of pixels of the pixel array and the level conversion unit for buffering and outputting the first level signal and the second level signal, obtained after the level conversions, to the rows of pixels of the pixel array to perform the line-by-line driving on the odd-numbered rows of pixels of the pixel array when the input buffer unit is inputted with the first control signal, and when the input buffer unit is inputted with the second control signal the output buffer unit line-by-line drives the even-numbered rows of pixels of the pixel array.

12. The driving method according to claim 11, wherein the shift register unit is a bidirectional shift register, and the input buffer unit is further for inputting a first direction setting signal and a second direction setting signal, and when the first direction setting signal is inputted a signal shifting direction of the bidirectional shift register is set as a first direction, and when the second direction setting signal is inputted, the signal shifting direction of the bidirectional shift register is set as a second direction.

13. The driving method according to claim 12, wherein the first direction setting signal and the second direction setting signal are level signals.

14. The driving method according to claim 11, wherein the first control signal and the second control signal are level signals.

15. The driving method according to claim 11, wherein the bit-shift control signal is a pulse signal.

* * * * *